US011161358B2

(12) United States Patent
Horie et al.

(10) Patent No.: US 11,161,358 B2
(45) Date of Patent: Nov. 2, 2021

(54) PRINTING APPARATUS

(71) Applicant: SEIKO EPSON CORPORATION, Tokyo (JP)

(72) Inventors: Seijun Horie, Matsumoto (JP); Hiroyuki Kobayashi, Suwa-Gun Shimosuwa-Machi (JP); Yoshihisa Horikawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/842,970

(22) Filed: Apr. 8, 2020

(65) Prior Publication Data

US 2020/0324560 A1 Oct. 15, 2020

(30) Foreign Application Priority Data

Apr. 10, 2019 (JP) ..... JP2019-074634

(51) Int. Cl.

| | |
|---|---|
| ***B41J 29/38*** | (2006.01) |
| ***B41J 13/00*** | (2006.01) |
| ***B41J 2/135*** | (2006.01) |
| ***B41J 3/407*** | (2006.01) |
| ***B41J 11/00*** | (2006.01) |
| ***B41J 15/04*** | (2006.01) |
| ***B41J 19/20*** | (2006.01) |
| ***B41J 25/34*** | (2006.01) |

(52) U.S. Cl.

CPC ..... *B41J 13/0009* (2013.01); *B41J 2/135* (2013.01); *B41J 3/4078* (2013.01); *B41J 11/002* (2013.01); *B41J 11/005* (2013.01); *B41J 15/048* (2013.01); *B41J 19/202* (2013.01); *B41J 25/34* (2013.01)

(58) Field of Classification Search

None

See application file for complete search history.

(56) References Cited

U.S. PATENT DOCUMENTS

| | | | | |
|---|---|---|---|---|
| 6,988,797 | B2 | 1/2006 | Samii et al. | |
| 2014/0368590 | A1* | 12/2014 | Shima | B41J 11/0015 347/102 |
| 2017/0210150 | A1* | 7/2017 | Mitsuo | B41J 11/002 |

FOREIGN PATENT DOCUMENTS

| | | | |
|---|---|---|---|
| JP | 2013049163 A | * | 3/2013 |
| JP | 2017-128828 A | | 7/2017 |

* cited by examiner

*Primary Examiner* — Erica S Lin
*Assistant Examiner* — Tracey M McMillion
(74) *Attorney, Agent, or Firm* — Workman Nydegger

(57) ABSTRACT

A printing apparatus includes an ejection unit including a nozzle surface configured to eject a liquid droplet, the nozzle surface facing a printing surface of a medium, a transport unit configured to transport the medium in a transport direction, a steam application unit configured to apply steam to the printing surface, the steam application unit being provided upstream of the ejection unit in the transport direction, and a medium compression unit configured to compress the medium, the medium compression unit being provided upstream of the ejection unit in the transport direction and downstream of the steam application unit in the transport direction.

5 Claims, 9 Drawing Sheets

PRINTING APPARATUS

The present application is based on, and claims priority from JP Application Serial Number 2019-074634, filed Apr. 10, 2019, the disclosure of which is hereby incorporated by reference herein in its entirety.

BACKGROUND

1. Technical Field

The present disclosure relates to a printing apparatus.

2. Related Art

JP-A-2017-128828 discloses a printing apparatus including a medium press unit, which is provided upstream of an ejection head in a transport direction and includes a medium pressing means for compressing a medium being a printing medium. With this, in a case where the medium has fluff, the fluff in a fluffing state before printing is compressed and shifted to a flat state, and an ejection defect caused by the fluff brought into contact with a nozzle surface of the ejection head is suppressed.

However, the related-art configuration has the following problem. That is, depending on a type of fibers forming the medium, the fluff in a fluffing state may not be shifted to a flat state simply by being compressed. Thus, the fluff is brought into contact with the nozzle surface of the ejection head, which may cause an ejection defect.

SUMMARY

In order to solve the above-mentioned problem, a printing apparatus according to the present disclosure includes an ejection unit including a nozzle surface configured to eject a liquid droplet, the nozzle surface facing a printing surface of a medium, a transport unit configured to transport the medium in a transport direction, a steam application unit configured to apply steam to the printing surface, the steam application unit being provided upstream of the ejection unit in the transport direction, and a medium compression unit configured to compress the medium, the medium compression unit being provided upstream of the ejection unit in the transport direction and downstream of the steam application unit in the transport direction.

DESCRIPTION OF EXEMPLARY EMBODIMENTS

Figure 1:
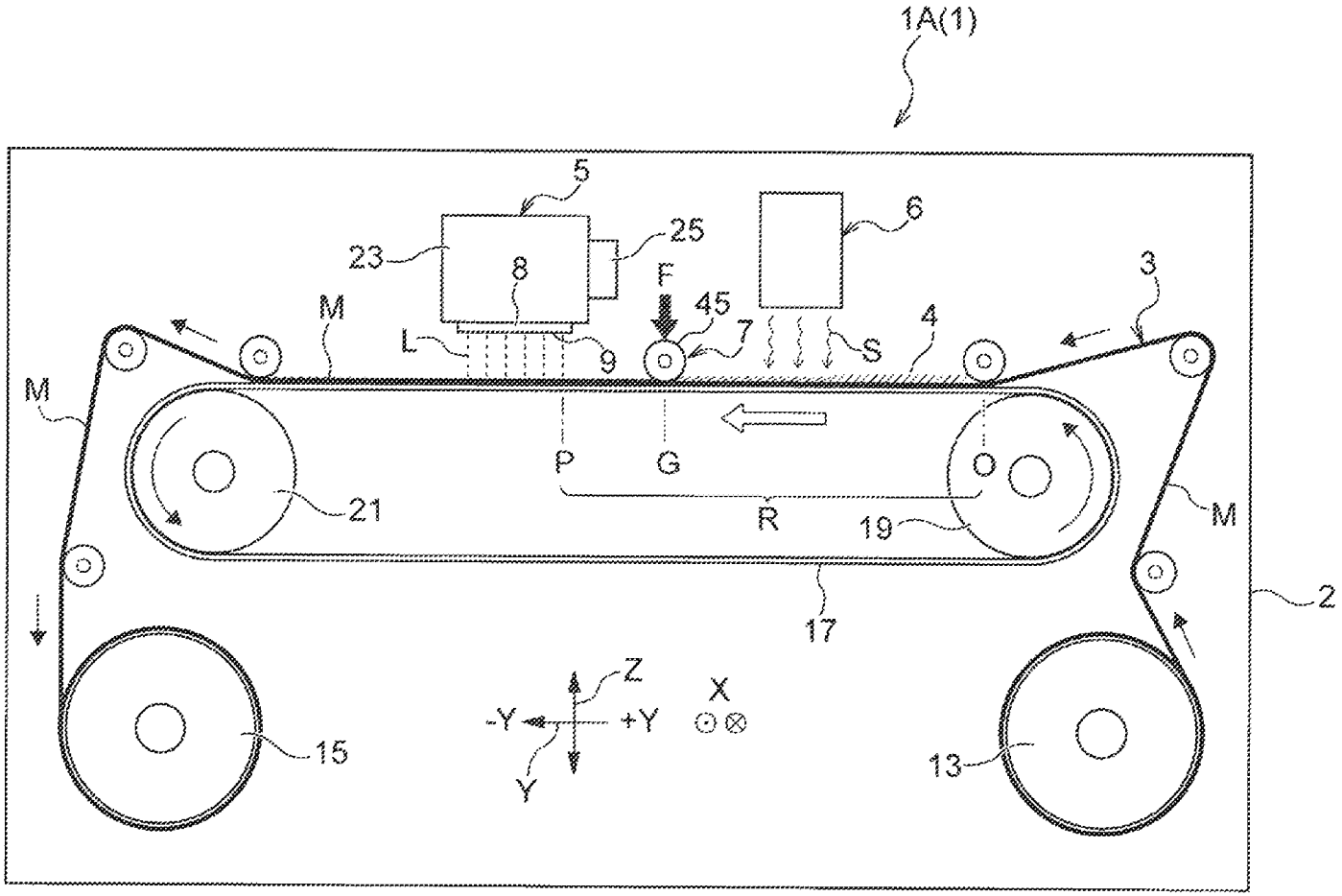
FIG. 1 is a side cross-sectional view illustrating an outline of an overall configuration of a printing apparatus according to an exemplary embodiment of the present disclosure.

First, the present disclosure will be schematically described.

In order to solve the above-mentioned problem, a printing apparatus according to a first aspect of the present disclosure includes an ejection unit including a nozzle surface configured to eject a liquid droplet, the nozzle surface facing a printing surface of a medium, a transport unit configured to transport the medium in a transport direction, a steam application unit configured to apply steam to the printing surface, the steam application unit being provided upstream of the ejection unit in the transport direction, and a medium compression unit configured to compress the medium, the medium compression unit being provided upstream of the ejection unit in the transport direction and downstream of the steam application unit in the transport direction.

According to the present aspect, the steam application unit applies steam to the medium, and thus fibers contained in the medium are softened. Further, under a state in which the fibers are softened, the medium compression unit provided downstream of the steam application unit in the transport direction compresses the medium. With this, after making easier to flatten the fluff, the medium is compressed. Thus, an ejection defect, which is caused by the fluff brought into contact with the nozzle surface, can be suppressed.

In a printing apparatus according to a second aspect of the present disclosure, in the first aspect, the steam application unit is configured to change an application range of steam in the transport direction.

Some of the types of the medium are likely to absorb moisture. In such case, when a large amount of steam is applied, swelling is caused, and creases are likely to be formed. When the medium is compressed under a state in which creases are formed, folds and the like are caused, which may cause a risk of degrading image quality.

According to the present aspect, the steam application unit is configured to change an application range of the steam in the transport direction. With this, in a case of the medium that is likely to swell, for example, the application range of the steam in the transport direction is narrowed, and thus the accumulated moisture amount applied to the medium is reduced. With this, the steam can be applied appropriately in accordance with types of the medium.

In a printing apparatus according to a third aspect of the present disclosure, in the first aspect or the second aspect, a partition portion is provided between the ejection unit and the steam application unit in the transport direction.

The steam generated from the steam application unit may arrive at the ejection unit in some cases. With this, an air current in the vicinity of the ejection unit is disturbed, which may cause a risk of degrading image quality.

According to the present aspect, the partition portion is provided between the ejection unit and the steam application unit. With this, the steam generated from the steam application unit can be prevented from arriving at the ejection unit, and degradation of image quality can be suppressed.

In a printing apparatus according to a fourth aspect of the present disclosure, in any one of the first aspect to the third aspect, the transport unit includes a support unit configured to support the medium being transported, and the medium compression unit is configured to contact the printing surface to press the medium against the support unit.

According to the present aspect, the medium compression unit is brought into contact with the printing surface, and presses the medium against the support portion, for example, an annular belt. With this, for example, as compared to a configuration in which the medium is compressed by a wind pressure in a non-contact manner on the printing surface, the medium can be compressed more securely. With this, the fluff formed on the printing surface can be flattened more easily.

In a printing apparatus according to a fifth aspect of the present disclosure, in the fourth aspect, the medium compression unit includes a heating unit configured to heat the printing surface.

According to the present aspect, the medium compression unit includes a heating portion that heats the printing surface. With this, the moisture amount of the medium is reduced by reaching the ejection unit, and ink bleed due to moisture, for example, bleed in a case of using dye ink can be suppressed.

A printing apparatus according to a sixth aspect of the present disclosure, in any one of the first aspect to the fifth aspect, further includes a carriage configured to accommodate the ejection unit and move in a scanning direction intersecting the transport direction, and a carriage shaft configured to support the carriage, wherein the steam application unit is coupled to the carriage the steam application unit being on an opposite side of the carriage shaft to the carriage in the transport direction.

According to the present aspect, a moment about the carriage shaft due to a mass of each of the carriage and the steam application unit is more stable as compared to a case that does not adopt the above-mentioned configuration.

Subsequently, an exemplary embodiment and modification examples of the present disclosure will be described with reference to the drawings.

Note that, in the following description, first, an outline of an overall configuration of a printing apparatus according to the present exemplary embodiment will be described with reference to FIG. 1. Next, with reference to FIG. 2 to FIG. 5, specific configurations of a steam application unit and a medium compression unit being main parts of the present exemplary embodiment will be described.

Then, configurations and operation states of four modification examples obtained by modifying a part of the configuration of the exemplary embodiment or adding a part of the configuration to the exemplary embodiment will be described.

Finally, other exemplary embodiments having configurations partially different from those of the exemplary embodiment and the modification examples will be simply described.

Exemplary Embodiment

Figure 2:
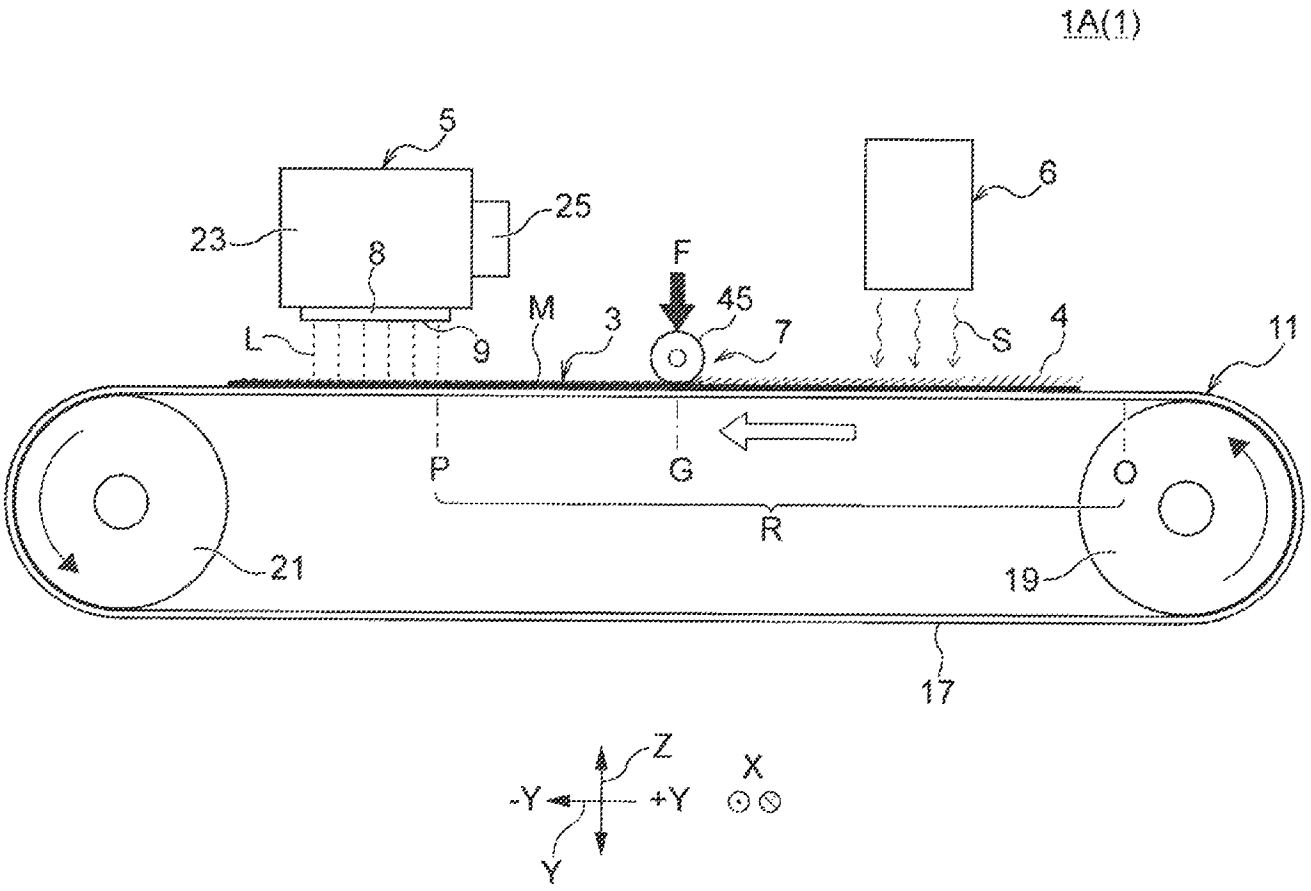
FIG. 2 is a side cross-sectional view illustrating main parts of the printing apparatus according to the exemplary embodiment of the present disclosure in an enlarged manner.

(1) Outline of Overall Configuration of Printing Apparatus (see FIG. 1 and FIG. 2)

A printing apparatus 1 according to the present disclosure includes an ejection unit 8 including a nozzle surface 9 that ejects a liquid droplet L onto a printing surface 3 of a medium M, a transport unit 11 that transports the medium M in a transport direction Y, a steam application unit 6 that is provided upstream +Y of the ejection unit 8 in the transport direction Y and applies a steam S to the printing surface 3, and a medium compression unit 7 that is provided upstream +Y of the ejection unit 8 in the transport direction Y and downstream −Y of the steam application unit 6 in the transport direction Y and compresses the medium M. The transport direction Y is parallel with the nozzle surface 9 in the vicinity of the ejection unit 8.

A printing apparatus 1A in the illustrated example is an ink-jet printing apparatus that performs printing on fabric having fluff 4 on the printing surface 3 as the medium M. An apparatus main body 2 of the printing apparatus 1A is provided with a feeding unit 13 that dispenses and feeds the medium M before being subjected to printing and a collecting unit 15 that winds and collects the medium M after being subjected to printing.

The medium M fed by the feeding unit 13 is applied to a transport conveyor 11 as illustrated, and is transported under a state of being pressed against and brought into close contact with a surface of a transport belt 17. The transport conveyor 11 corresponds to a transport unit, and the transport belt 17 corresponds to a support unit.

Note that the transport conveyor 11 includes a drive roller 19, a driven roller 21 provided at a position away from the drive roller 19 in the transport direction Y, and the endless transport belt 17 wound between the drive roller 19 and the driven roller 21. Above the intermediate position of the transport conveyor 11, a printing unit 5 is provided. The printing unit 5 includes an ejection head 8 being the ejection unit 8 that ejects, onto the printing surface 3 of the medium M, ink of each color being one example of the liquid droplet L applied from an ink tank or the like, a carriage 23 that retains the ejection head 8 and reciprocates in a scanning direction being a width direction X of the apparatus main body 2 intersecting the transport direction Y of the medium M, a carriage shaft 25 that guides motion of the carriage 23, and a drive device (not shown) that applies a driving force to the carriage 23.

Further, the transport belt 17 is a so-called adhesive belt having a surface onto which an adhesive is applied. With this, the medium M can be caused to adhere to the surface of the transport belt 17. Note that the transport belt 17 is not limited to an adhesive belt, and may be an electrostatic belt using an electrostatic force or an air suction belt using air suction.

Further, the steam application unit 6 is provided at a position upstream +Y in the transport direction Y in a region R between a feeding position O of the fed medium M on the transport conveyor 11 and an ejection position P of the liquid droplet L ejected from the ejection head 8. The medium compression unit 7 is provided at a position downstream −Y in the transport direction Y in the region R.

(2) Specific Configurations of Main Parts of Printing Apparatus (see FIG. 2 to FIG. 5)

Figure 4:
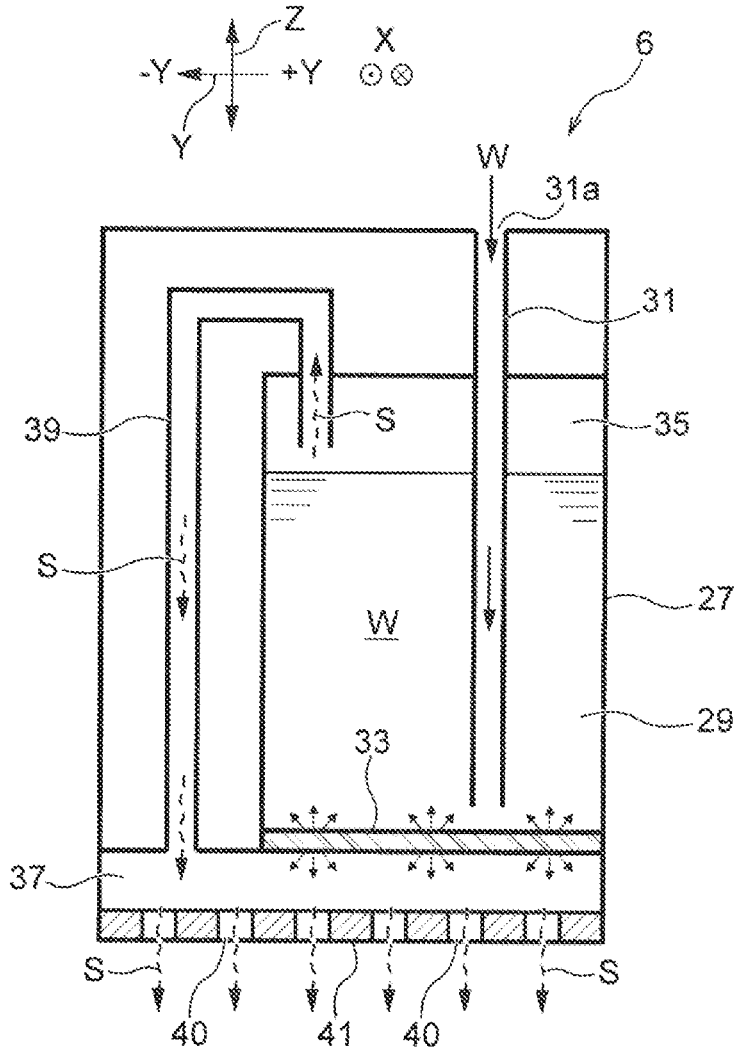
FIG. 4 is a side cross-sectional view illustrating one example of a steam application unit of the printing apparatus according to the exemplary embodiment of the present disclosure.

The steam application unit 6 having a configuration illustrated in FIG. 4 may be used, for example. The steam application unit 6 includes a storage tank 29 that accommodates water W in a housing 27, an injection tube 31 having an injection port 31*a* that is used when the water W is injected in the storage tank 29, a heater 33 provided on the bottom portion of the storage tank 29, a vaporization chamber 35 in an upper part of the storage tank 29, which is filled with the steam S generated by vaporizing the water W in the storage tank 29, a steam chamber 37 provided in a lower part of the storage tank 29, a steam guide tube 39 that communicates the vaporization chamber 35 and the steam chamber 37, and a base plate 41 in a lower part of the steam chamber 37, which faces the printing surface 3 of the medium M has a large number of steam holes 40.

Note that a space volume of the steam chamber 37 is preferably reduced as much as possible. When the space volume of the steam chamber 37 is reduce, heat of the heater 33 is more likely to be transmitted to the base plate 41 due to thermal conduction and convection current through the steam S filling the steam chamber 37. Thus, a thermal gradient in a vertical direction Z is reduced. Specifically, a distance between the heater 33 and the base plate 41 in the vertical direction Z is reduced as much as possible. With this, until heat energy of the heater 33 is transmitted to the base plate 41 due to thermal conduction and convection current, reduction in the heat energy can be suppressed. This is because reduction in the heat energy is larger as the distance between the heater 33 and the base plate 41 is increased.

With this, the base plate 41 is heated efficiently. As a result, the steam S is prevented from being condensed on the base plate 41, and the water W is prevented from falling from the steam holes 40 in a form of a droplet.

Further, the steam guide tube 39 and the heater 33 are preferably arranged at positions away from each other in the transport direction Y. When the steam guide tube 39 and the heater 33 are arranged in this manner, the heater 33 is not required to be increased more than necessary, and the temperature in the steam chamber 37 can be heated to be a required temperature. Specifically, in the steam chamber 37, the vicinity of a coupling portion between the steam guide tube 39 and the steam chamber 37 is less likely to be at a condensation temperature due to a temperature of the steam S even when the heater 33 is not arranged. Power consumption of the heater 33 is proportional to the size of the heater 33. Therefore, when the heater 33 is arranged at a position away from the coupling portion between the steam guide tube 39 and the steam chamber 37 in the transport direction Y, the heater 33 is not increased more than necessary, and power consumption of the heater 33 can be suppressed.

Further, the temperature of the steam S generated as described above is set to a temperature falling within a range of from 140° C. to 160° C. as one example.

Moreover, in the present exemplary embodiment as described above, in addition to the function of directly heating the water W in the storage tank 29 and generating the steam S, the heater 33 has the function of indirectly heating the base plate 41 by heating the steam chamber 37 and preventing dew condensation of the steam S on the base plate 41.

Further, in the present exemplary embodiment, the steam application unit 6 is configured to change an application range A of the steam S in the transport direction Y.

Figure 5:
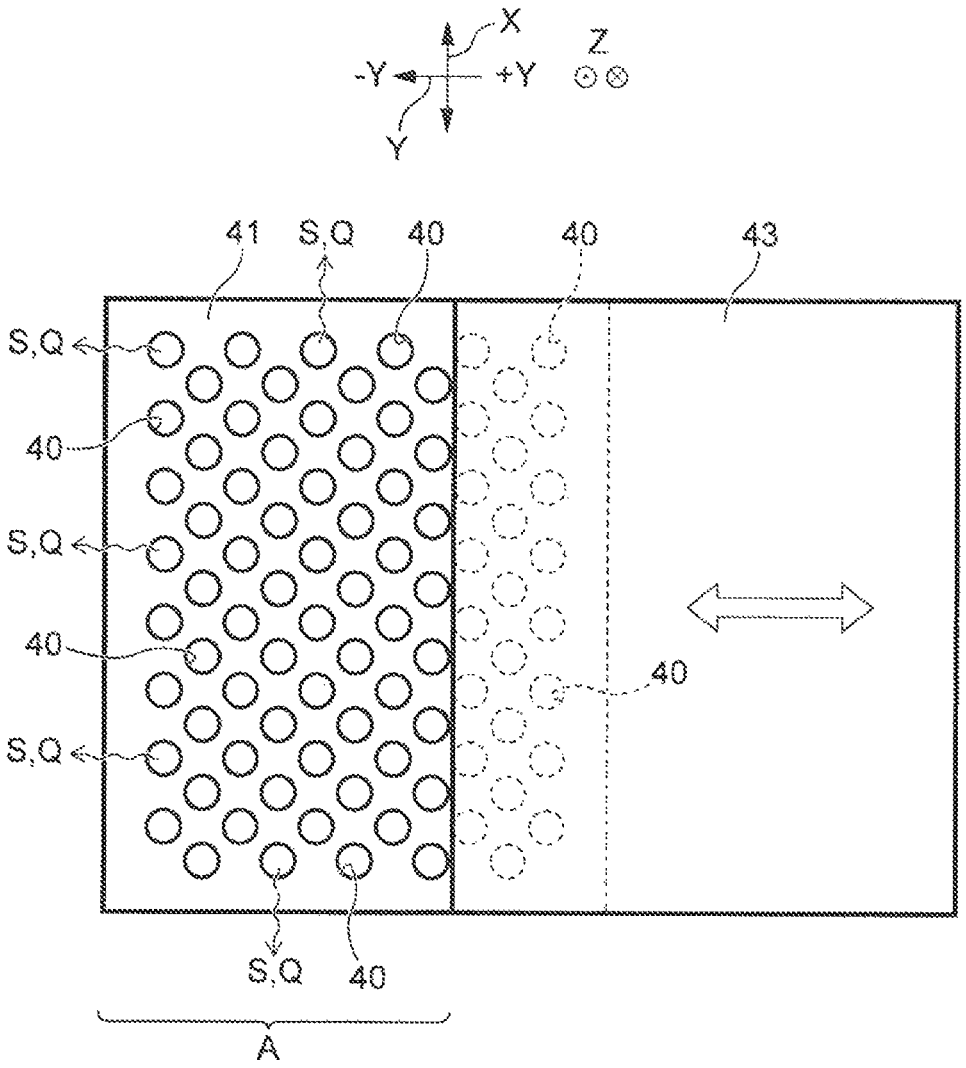
FIG. 5 is a side cross-sectional view illustrating one example of the steam application unit of the printing apparatus according to the exemplary embodiment of the present disclosure.

Specifically, as illustrated in FIG. 5, a shutter 43 capable of covering at least a part of the steam holes 40 formed in the base plate 41 is provided. When the shutter 43 reciprocates in the transport direction Y, the application range A of the steam S in the transport direction Y can be changed. The shutter 43 may reciprocate in the transport direction Y with a manual operation by a user, or may reciprocate in the transport direction Y with an actuator such as a solenoid (not shown). When the shutter 43 reciprocates in the transport direction Y with a manual operation by a user, scales may be formed on the base plate 41 along the transport direction Y, and an edge of the shutter 43 in the transport direction Y may match with the scales in accordance with types of the medium M.

With this, for example, a steam amount Q [g/s] per unit time can be changed in accordance with types of the medium M. Specifically, when fibers of the medium M are soft and likely to swell, the application range A of the steam S in the transport direction Y is reduced, and formation of creases on the medium M is reduced.

In contrast, when fibers of the medium M are hard and the fluff 4 is less likely to be flat, the application range A of the steam S in the transport direction Y is increased, and the steam amount Q [g/s] per unit time is increased. With this, the fluff 4 is likely to be flat.

As the medium compression unit 7, a press roller 45, which is brought into contact with and presses the printing surface 3 of the medium M, may be adopted. The press roller 45 is a cylindrical member extending in the width direction X. Further, in order to reduce bending of the transport belt 17 at the time of pressing by the press roller 45 and exert a pressing effect prominently, an additional support member such as a support plate and a support roller (not shown) is preferably arranged on a back surface side of the transport belt 17. Note that the press roller 45 may be a drive roller that rotates in a direction of flattening the fluff 4, or may be a driven roller that does not actively drive and a bar member that does not rotate.

Further, as other medium compression units 7 in place of the press roller 45, a pressing piece formed of a block or flat pressing pad, a curved plate member, or the like, a member for flattening the fluff 4 by applying a wind pressure and compressing the fluff, or the like may be adopted.

As described above, in the present exemplary embodiment, the printing apparatus 1A includes the transport conveyor 11 being a transport unit and the transport belt 17 being a support unit that supports the medium M to be transported. Further, the press roller 45 being the medium compression unit 7 is brought into direct contact with the printing surface 3 of the medium M, and presses the medium M against the transport belt 17. With this, the fluff 4 of the printing surface 3 of the medium M is flattened.

Figure 3:
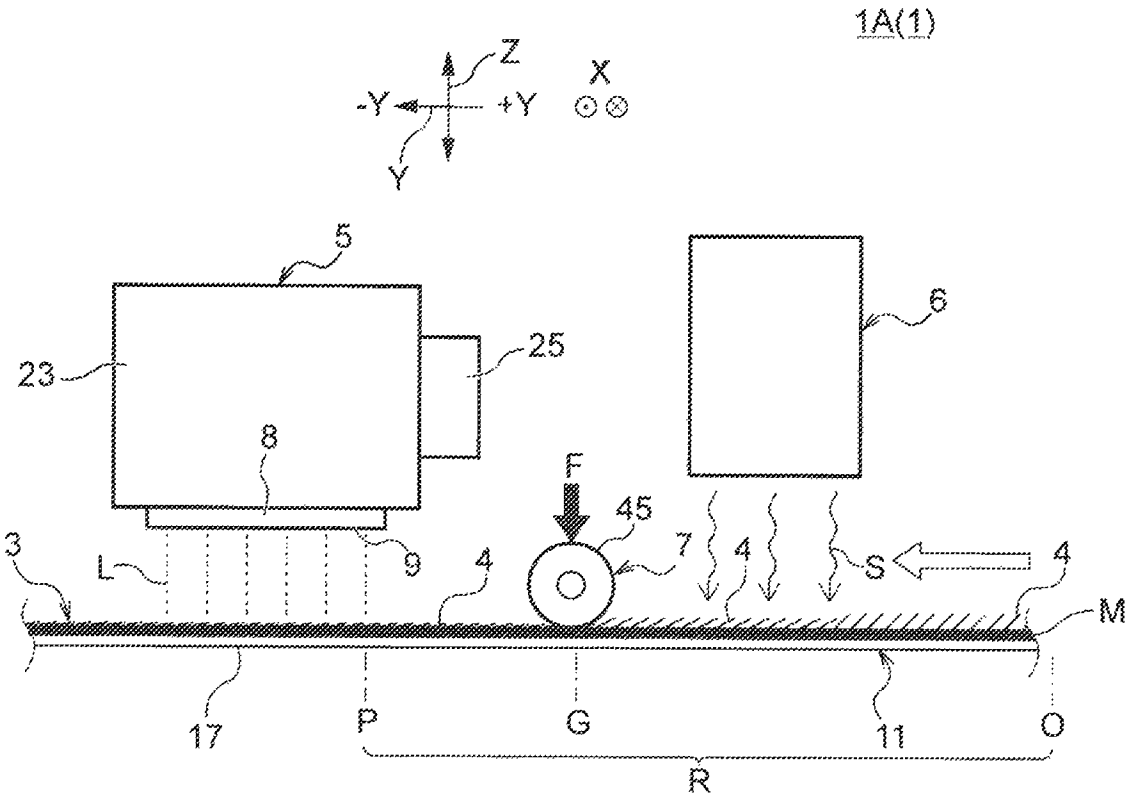
FIG. 3 is a view illustrating the printing apparatus according to the exemplary embodiment of the present disclosure, and is a side cross-sectional view illustrating a state in which fluff on a printing surface of a medium is shifted from a fluffing state to a flat state.

(3) Operation Mode of Main Parts of Printing Apparatus (see FIG. 3)

Next, an operation mode of the main parts of the printing apparatus 1A according to the present exemplary embodiment configured as described above will be described specifically in a separate manner in (A) a stage of applying steam and (B) a stage of compressing a medium.

(A) Stage of Applying Steam

The medium M, which is fed from the feeding unit 13 and supplied to the transport conveyor 11, is pressed against and brought into contact with the surface of the transport belt 17 being a support unit at the feeding position O, and is sent to the transport direction Y.

First, the steam application unit 6 acts on the medium M sent by the transport belt 17 in the transport direction Y, and applies the steam S onto the printing surface 3 of the medium M. With this, the printing surface 3 of the medium M is in a predetermined infiltration state.

That is, the water W in the storage tank 29 is heated by the heater 33, and the steam S is generated. The generated steam S is guided by the steam guide tube 39 from the vaporization chamber 35 to the steam chamber 37, and the steam S is jetted onto the facing printing surface 3 of the medium M through the steam holes 40 in the base plate 41. With this, the predetermined infiltration state in which the fluff 4 of the printing surface 3 of the medium M can be flattened is obtained. The predetermined infiltration state is achieved by applying an appropriate steam amount Q to the medium M in accordance with types of the medium M. Examples of the types of the medium M include, for example, plant fibers such as cotton and hemp, animal fibers such as silk and wool, and synthetic fibers such as polyesters and nylons.

In this case, in order to secure the steam amount Q corresponding to the type of the medium M to be used, the number of steam holes 40 to be used, that is, the application range A of the steam S is adjusted by the shutter 43 reciprocating in the transport direction Y. For example, the application range A of the steam S is changed for the medium M being fibers formed of polyesters and for the medium M being fibers formed of cotton. Specifically, the application range A of the steam S is changed, and thus the steam amount Q applied to the medium M formed of polyesters is less than the steam amount Q applied to the medium M formed of cotton. This is because cotton has higher water absorbability than polyesters. When the steam amount Q applied to the medium M formed of cotton is more than the steam amount Q applied to the medium M formed of polyesters, there may be a risk of swelling and generating creases.

Further, heat of the heater 33 is transmitted to the base plate 41 via the steam chamber 37, and hence the base plate 41 is heated, and generation of dew condensation on the base plate 41 is also suppressed.

(B) Stage of Compressing Medium

The medium M having fibers forming the fluff 4 of the printing surface 3, which are applied with the steam S and softened, is further sent in the transport direction Y, and supplied to a pressing position G at which the press roller 45 is present.

At the pressing position G, the medium M receives a pressing force F of the press roller 45, and is compressed. With this, the printing surface 3 of the medium M is in a state in which the fluff 4 is inclined and flattened (a state in which the fluff 4 is substantially along the printing surface 3), the flat state is maintained, and the substantially plane state is obtained. Then, the medium M is transported.

Further, the liquid droplet L is ejected onto the printing surface 3 of the medium M thus brought in such plane state, printing with a high resolution is performed, and the fluff 4 is prevented from adhering to the nozzle surface 9. In this manner, a printed material with high quality is output.

(4) Configurations and Operation Conditions of Modification Examples of Printing Apparatus (see FIG. 6 to FIG. 9)

Next, configurations and operation states of four modification examples including Modification Example 1 to Modification Example 4 obtained by modifying a part of the configuration of the exemplary embodiment or adding a part of the configuration to the exemplary embodiment will be described.

Figure 6:
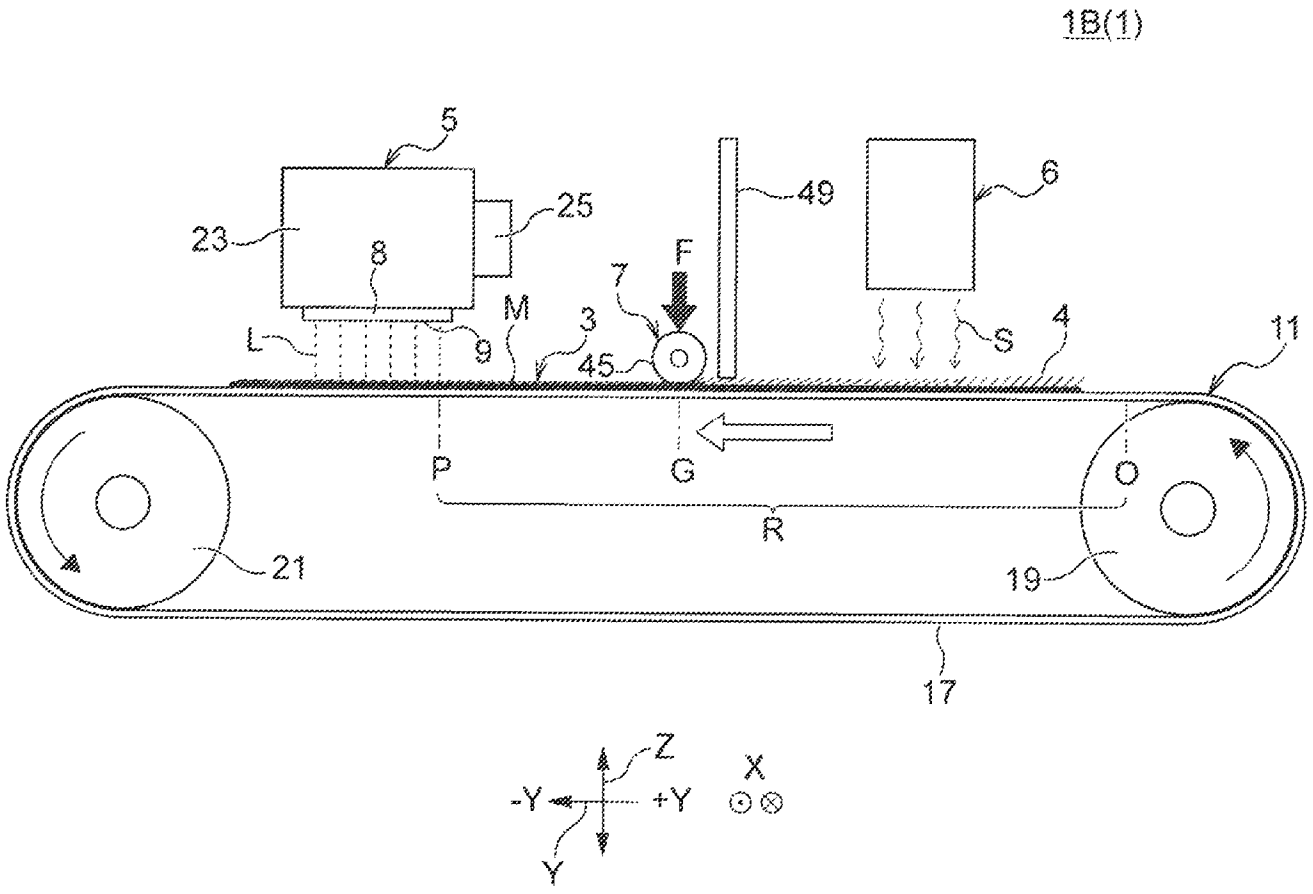
FIG. 6 is a side cross-sectional view illustrating a printing apparatus in Modification Example 1 of the exemplary embodiment of the present disclosure.

(A) Modification Example 1 (see FIG. 6)

A printing apparatus 1B in Modification Example 1 illustrated in FIG. 6 is a modification example in which a partition portion 49 is provided between the ejection unit 8 and the steam application unit 6. Specifically, in the transport direction Y, between the press roller 45 being the medium compression unit 7 and the steam application unit 6, for example, a partition plate being the partition portion 49 is arranged. Further, in order to prevent the steam S from flowing to the ejection unit 8 side, the partition plate controls flow of the steam S from the steam application unit 6 to the ejection unit 8. In the vertical direction Z, a lower end of the partition plate is positioned slightly above the surface of the transport belt 17. With this, the lower end of the partition plate can be prevented from interfering the surface of the medium M placed on the surface of the transport belt 17, and the surface of the medium M can be prevented from being damaged.

Further, the partition portion 49 provided as described above can suppress degradation of image quality caused by the steam S, which is jetted through the steam holes 40 in the base plate 41 of the steam application unit 6, flows around the printing region in the vicinity of the ejection unit 8, and disturbs an air current. In this case, when the partition plate is used as the partition portion 49, the width dimension of the partition plate in the width direction X is preferably equal to or more than the range in which the steam application unit 6 applies the steam S in the width direction X. In other words, in the width direction X, the width dimension of the partition plate is preferably equal to or more than the width dimension of the base plate 41. With this, the steam S can further be prevented from flowing around the printing region in the vicinity of the ejection unit 8 in the width direction X. Further, the height dimension of the partition plate in the vertical direction Z is preferably equal to or more than the distance between the surface of the transport belt 17 and the surface of the base plate 41, which faces the surface of the transport belt 17. With this, the steam S can further be prevented from flowing around the printing region in the vicinity of the ejection unit 8 in the vertical direction Z. Further, when the press roller 45 is used as the medium compression unit 7, the lower end of the partition plate preferably overlaps with the press roller 45 in the vertical direction Z as seen in the transport direction Y. In other words, in the width direction X and the vertical direction Z, the lower end of the partition plate preferably overlaps with the press roller 45. With this, the press roller 45 controls flow of the steam S leaking out from a gap between the lower end of the partition plate and the transport belt 17, and the steam S can further be prevented from flowing to the ejection unit 8 side.

Note that, in place of the partition portion 49 other than a structure such as the partition plate partitioning the ejection unit 8 and the steam application unit 6, there may be adopted a method of sending a wind and preventing the steam S jetted from the steam application unit 6 from flowing in the ejection unit 8. Further, the shape of the partition plate is only required to prevent the steam S from flowing in the ejection unit 8, and is not required to be a plate illustrated in FIG. 6. For example, the thickness dimension of the partition plate in the transport direction Y is not required to be constant in at least one of the width direction X and the vertical direction Z.

Figure 7:
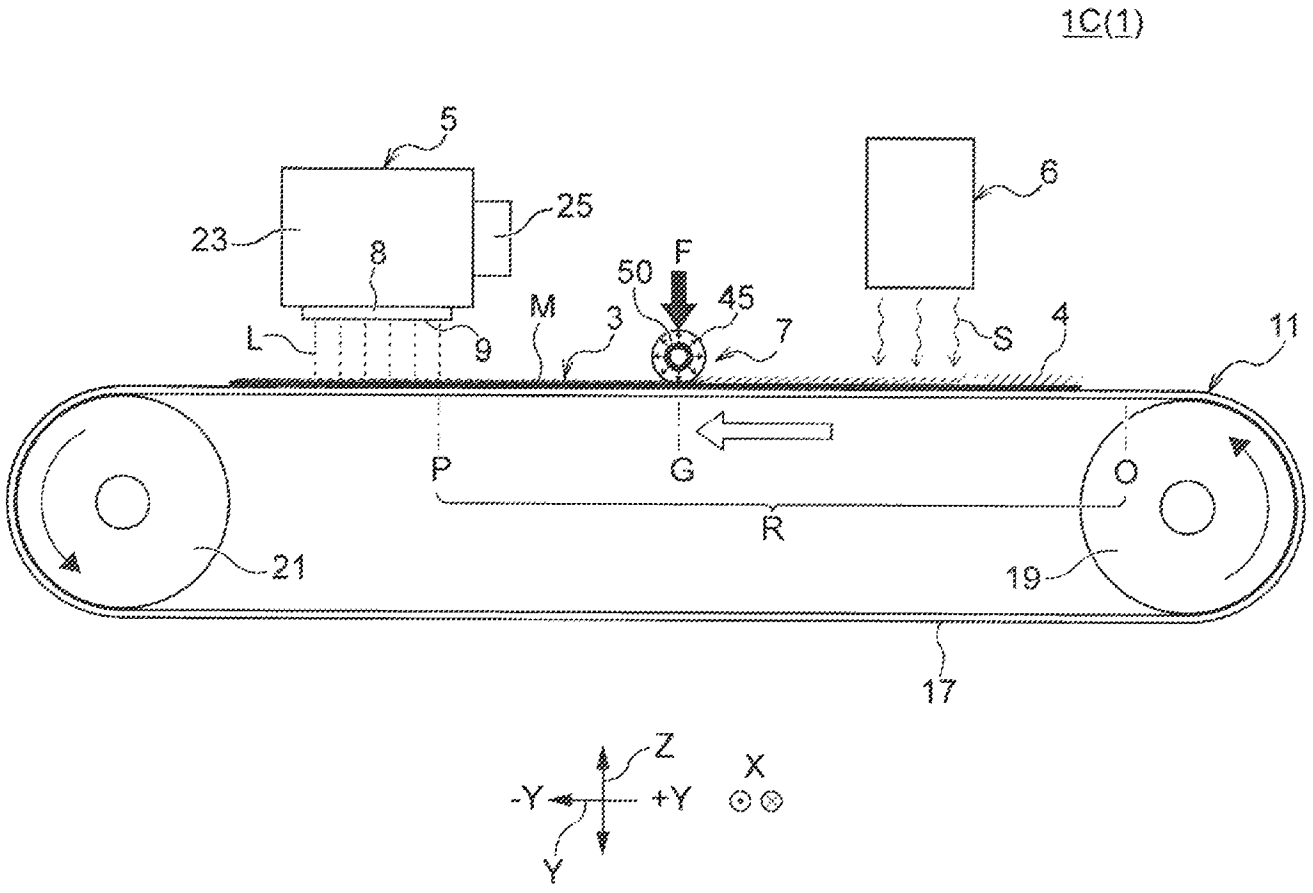
FIG. 7 is a side cross-sectional view illustrating a printing apparatus in Modification Example 2 of the exemplary embodiment of the present disclosure.

(B) Modification Example 2 (see FIG. 7)

A printing apparatus 1C in Modification Example 2 illustrated in FIG. 7 is a modification example in which a heating portion 50 that heats the printing surface 3 of the medium M is provided to the medium compression unit 7.

Specifically, the heating portion 50 is provided in the press roller 45 being the medium compression unit 7. Alternatively, heating is performed by transmitting, to the press roller 45, heat of the heating portion 50 provided outside. With this, in addition to the function of compressing the printing surface 3 of the medium M, the press roller 45 additionally has a function of drying the printing surface 3 of the medium M.

That is, moisture of the steam S applied by the steam application unit 6 is intended only for flattening the fluff 4 easily, and the moisture is not required to remain at the time of printing by the ejection unit 8. Rather, when the moisture remains, ink bleed or the like is disadvantageously caused in a case of using dye ink, for example.

In view of this. as in this modification example, the press roller 45 is provided with the heating portion 50. Alternatively, heating is performed by transmitting heat from the heating portion 50 to the press roller 45, drying of moisture remaining on the printing surface 3 of the medium M is promoted. Thus, printing of image with high quality in which ink bleed or the like is suppressed can be achieved.

Figure 8:
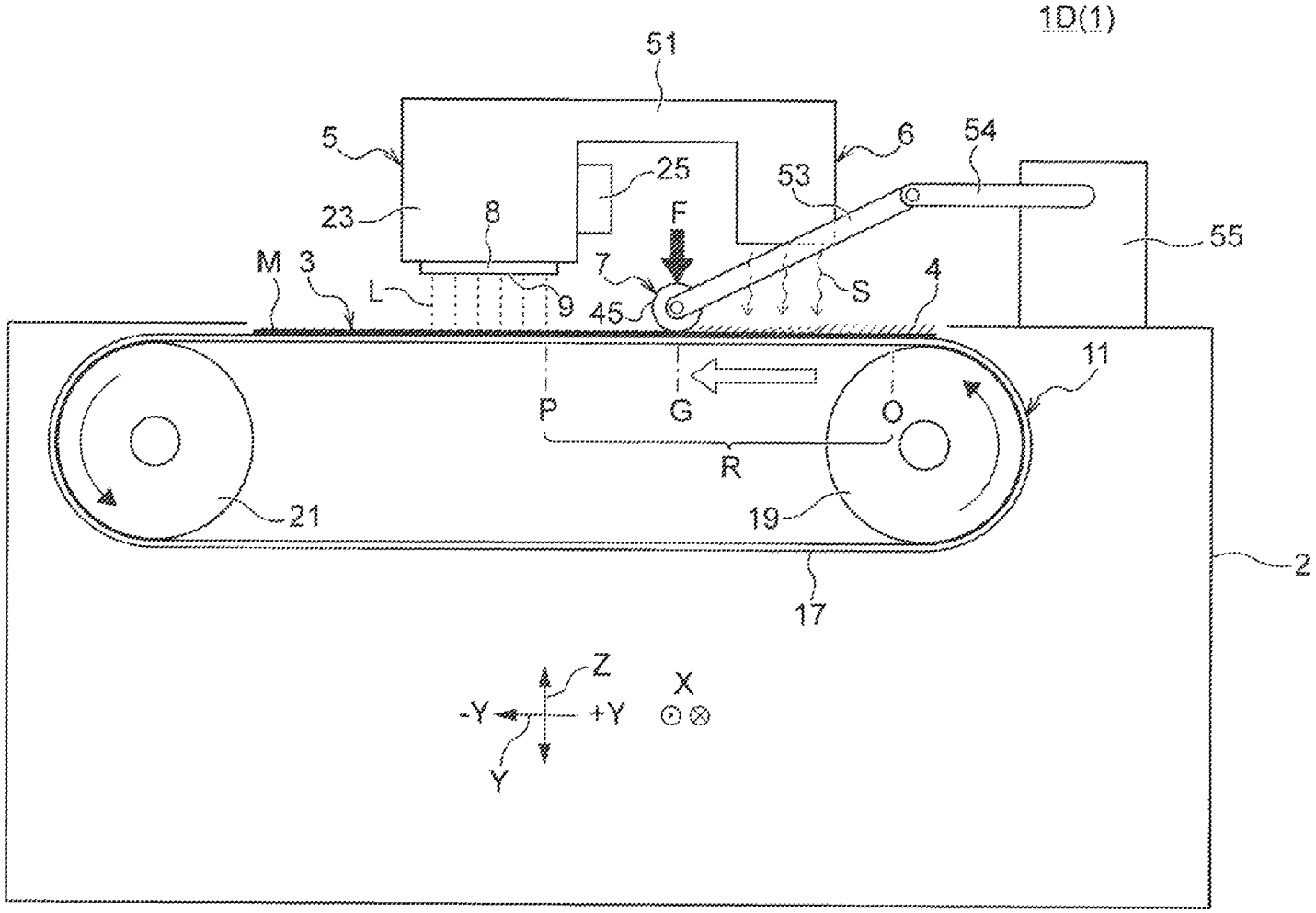
FIG. 8 is a side cross-sectional view illustrating a printing apparatus in Modification Example 3 of the exemplary embodiment of the present disclosure.

(C) Modification Example 3 (see FIG. 8)

A printing apparatus 1D in Modification Example 3 illustrated in FIG. 8 includes the carriage 23 that accommodates the ejection unit 8 and reciprocates in the width direction X intersecting the transport direction Y as the scanning direction, and the carriage shaft 25 that supports the carriage 23. The steam application unit 6 is coupled to the carriage 23 so as to be positioned on a side opposite to the carriage 23 across the carriage shaft 25 in the transport direction Y.

Note that, as a mode of coupling the carriage 23 and the steam application unit 6, as in the illustrated example, both the members may be coupled via a coupling member 51, or the steam application unit 6 may be incorporated in the carriage 23 by devising the shape of the housing of the carriage 23.

Further, as in this modification example, when the steam application unit 6 is coupled to the carriage 23, the application range of the steam S of the steam application unit 6 in the width direction X may be set to substantially the same range as the ejection range of the liquid droplet L of the ejection head 8 in the width direction X, which is mounted to the carriage 23.

Incidentally, with this configuration, in the width direction X being the scanning direction of the carriage 23, the steam holes 40 may be provided within a range narrower than the maximum width of the medium M in accordance with the width dimension of the medium M. Specifically, the housing 27 of the steam application unit 6 is integrally formed with the carriage 23. In the width direction X, the width dimension of the carriage 23 is designed to be smaller than the width dimension of the transport belt 17. In this manner, the width dimension of the housing 27 of the steam application unit 6 can be designed smaller than the width dimension of the transport belt 17. Particularly, one side wall on a +X side and the other side wall on a −X side in the width direction X of each of the carriage 23, the coupling portion 51, and the housing 27 of the steam application unit 6 are designed to be parallel with each other. In this manner, the width dimension of the housing 27 of the steam application unit 6 can be designed to be smaller than the width dimension of the transport belt 17. With this, when the width dimension of the medium M is smaller than the width dimension of the transport belt 17, the steam S can be prevented from being jetted onto a part of the transport belt 17, which is not covered with the medium M. Therefore, degradation of the surface of the transport belt 17, which is caused by jetting of the steam S, or the like can be suppressed. For example, degradation of an adhesive agent applied on the surface of the transport belt 17, which is caused by the steam S having a high temperature, reduction in adhesive force, and reduction in durability can be suppressed.

That is, when the steam application unit 6 is coupled to the carriage 23, the steam application unit 6 is movable in the width direction X being the scanning direction together with the carriage 23. Thus, the steam S can be applied in the scanning range in accordance with the scanning range of the carriage 23, which is changed in conformity of the width dimension of the medium M.

Further, in the case of this modification example, along with motion of the carriage 23, the steam application unit 6 also moves in the width direction X being the scanning direction. Thus, the support member that supports the press roller 45 is preferably provided outside of the movable range of the carriage 23 and the steam application unit 6 in the width direction X. Incidentally, in this modification example, the support member of the press roller 45, which includes two arms 53 and 54 and an arm support table 55, is provided at the position outside of the movable range of the carriage 23 and the steam application unit 6 in the width direction X. With this, the carriage 23 and the steam application unit 6 can be prevented from interfering the support member of the press roller 45.

Figure 9:
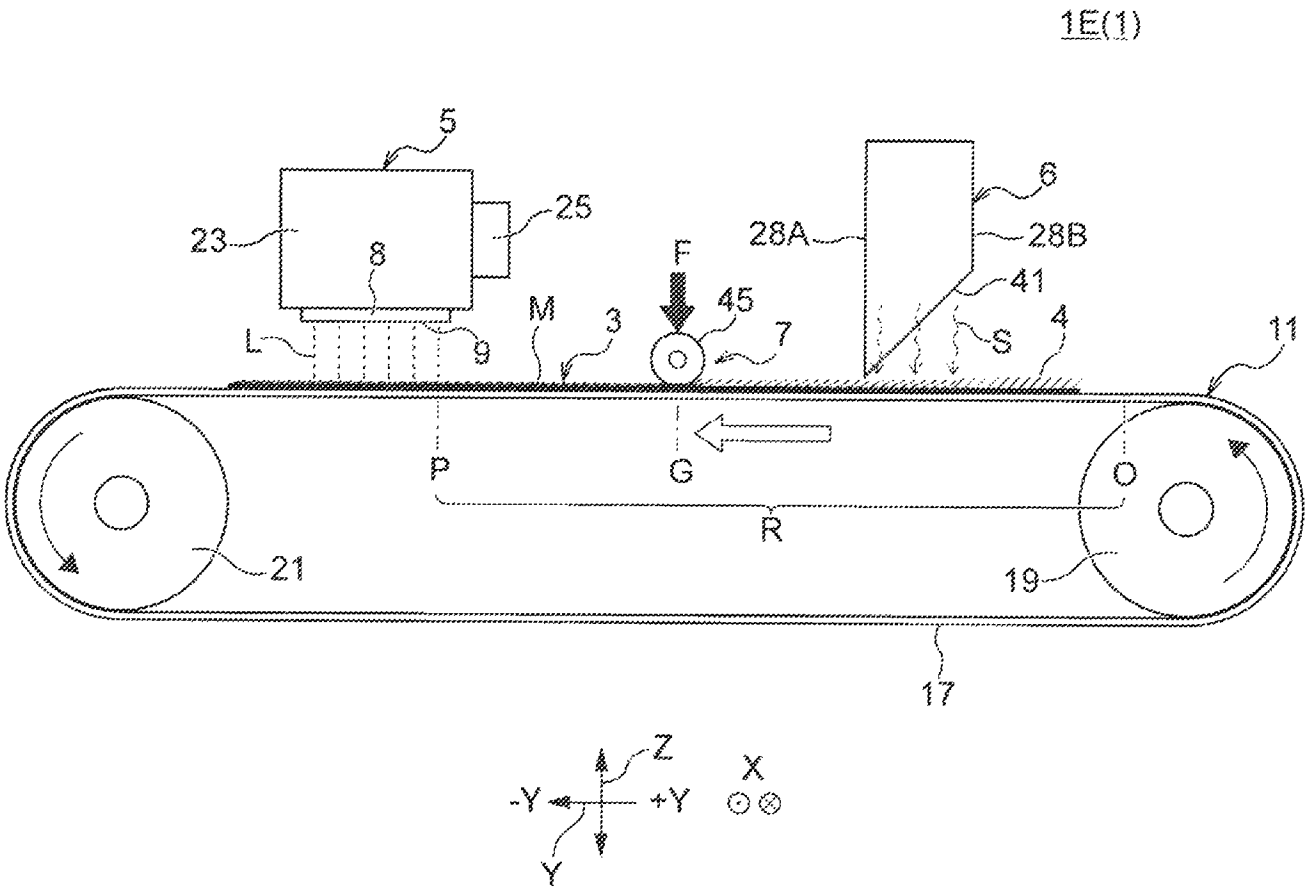
FIG. 9 is a side cross-sectional view illustrating a printing apparatus in Modification Example 4 of the exemplary embodiment of the present disclosure.

(D) Modification Example 4 (see FIG. 9)

In a printing apparatus 1E in Modification Example 4 illustrated in FIG. 9, the base plate 41 of the steam application unit 6 in which the steam holes 40 are formed is arranged to be inclined upward on the upstream +Y in the transport direction Y. Further, in the housing 27 of the steam application unit 6, a side wall 28A on the downstream −Y side in the transport direction Y is longer than a side wall 28B on the upstream +Y side in the transport direction Y.

Incidentally, when the steam application unit 6 having such configuration is adopted, the steam S jetted through the steam holes 40 formed in the inclined base plate 41 is jetted upstream +Y in the transport direction Y away from the ejection unit 8. Further, the long side wall 28A of the steam application unit 6 on the downstream 'Y side in the transport direction Y functions as the partition portion 49 described in Modification Example 1, and prevents the steam S from flowing to the ejection unit 8 side.

Other Exemplary Embodiments

The printing apparatus 1 according to the present disclosure is based on the configurations described above. However, as a matter of course, modifications, omission, and the like may be made to a partial configuration without departing from the gist of the present disclosure of the present application.

For example, a generation portion of the steam S of the steam application unit 6 may be provided in a separate place outside of the housing 27, and the steam S may be supplied into the housing 27 via a tube or the like. In a case with such configuration, only a nozzle for jetting the steam S may be provided upstream of the press roller 45 in the transport direction Y, and the nozzle may be used as the steam application unit 6.

In addition, the steam application unit 6 and the medium compression unit 7 may be formed as an integrated unit. Incidentally, with such configuration, variation of the mounting positions of both the members is reduced, and maintenance is facilitated.

Further, a configuration of adjusting a pressing force or a pressing amount of the medium compression unit 7 may be adopted. Specifically, an elastic member formed of a spring member, a rubber member, or the like acts on the medium compression unit 7, and an acting height of the medium compression unit 7 is changed in accordance with a material, a thickness, and the like of the medium M. With this, an appropriate pressing force F or an appropriate pressing amount may be obtained.

For example, as a configuration of changing the steam amount Q [g/s] per unit time in accordance with types of the medium M, a valve may be provided to the steam guide tube 39. The valve may be controlled by an actuator (not shown), for example, and the amount of the steam S flowing through the steam guide tube 39 may be controlled.

What is claimed is:

1. A printing apparatus comprising:

an ejection unit including a nozzle surface configured to eject a liquid droplet, the nozzle surface facing a printing surface of a medium;

a transport unit configured to transport the medium in a transport direction;

a steam application unit configured to apply steam to the printing surface, the steam application unit being provided upstream of the ejection unit in the transport direction;

a carriage configured to accommodate the ejection unit and move in a scanning direction intersecting the transport direction;

a carriage shaft configured to support the carriage; and a medium compression unit configured to compress the medium, the medium compression unit being provided upstream of the ejection unit in the transport direction and downstream of the steam application unit in the transport direction, wherein the steam application unit is coupled to the carriage such that the steam application unit is movable in the scanning direction together with the carriage, the steam application unit being on an opposite side of the carriage shaft to the carriage in the transport direction.

2. The printing apparatus according to claim 1, wherein the steam application unit is configured to change an application range of steam in the transport direction.

3. The printing apparatus according to claim 1, wherein a partition portion is provided between the ejection unit and the steam application unit in the transport direction.

4. The printing apparatus according to claim 1, wherein the transport unit includes a support unit configured to support the medium being transported, and the medium compression unit is configured to contact the printing surface to press the medium against the support unit.

5. The printing apparatus according to claim 4, wherein the medium compression unit includes a heating unit configured to heat the printing surface.

* * * * *